US007455098B2

(12) United States Patent
Wober et al.

(10) Patent No.: US 7,455,098 B2
(45) Date of Patent: Nov. 25, 2008

(54) PERMANENT CHILL MOLD FOR THE CONTINUOUS CASTING OF METALS

(75) Inventors: Hans-Günter Wober, Bramsche (DE); Gerhard Hugenschütt, Belm (DE); Dietmar Kolbeck, Steinfeld (DE); Raimund Boldt, Osnabrück (DE); Frank Maiwald, Westerkappeln (DE); Daniel Reinelt, Osnabrück (DE); Hans-Dirk Piwowar, Osnabrück (DE); Dirk Rode, Osnabrück (DE)

(73) Assignee: KME Germany AG & Co. KG, Osnabruck (DE)

( * ) Notice: Subject to any disclaimer, the term of this patent is extended or adjusted under 35 U.S.C. 154(b) by 73 days.

(21) Appl. No.: 11/606,429

(22) Filed: Nov. 29, 2006

(65) Prior Publication Data

US 2007/0125511 A1 Jun. 7, 2007

(30) Foreign Application Priority Data

Nov. 30, 2005 (DE) ..... 10 2005 057 580

(51) Int. Cl.
*B22D 11/041* (2006.01)

(52) U.S. Cl. ..... 164/418; 164/459

(58) Field of Classification Search ..... 164/418, 164/459

See application file for complete search history.

(56) References Cited

U.S. PATENT DOCUMENTS 6,024,162 A * 2/2000 Uehara et al. ..... 164/478
6,419,005 B1 * 7/2002 Korpela ..... 164/491

FOREIGN PATENT DOCUMENTS

EP 958871 A1 * 11/1999
JP 2003311378 A * 11/2003

* cited by examiner

*Primary Examiner*—Kuang Lin
(74) *Attorney, Agent, or Firm*—Kenyon & Kenyon LLP

(57) ABSTRACT

A permanent chill mold for the continuous casting of metal, having a mold cavity (2) which has a pouring slot (3), an exit opening (4) and a casting cone (6). At least one concave bulging (7) is provided that extends in the casting direction (G), which begins at a distance (A) below a predetermined casting bath level position (5) and extends up to the exit opening (4).

17 Claims, 4 Drawing Sheets

PERMANENT CHILL MOLD FOR THE CONTINUOUS CASTING OF METALS

BACKGROUND OF THE INVENTION

1. Field of the Invention

The invention generally relates to a permanent chill mold for the continuous casting of metals.

2. Description of Related Art

Tube-shaped chill molds made of copper or copper alloys, for casting profiles made of steel or other metals having a high melting point have been described many times in the related art. Permanent chill tubes usually have a uniform wall thickness in a horizontal cross sectional plane, which increases in the direction of the billet because of the inner conicity or taper of the chill tube. The conicity is able to be the same over the entire length of the permanent chill mold. However, conicities that are variable over the length may also be used, and the conicity may be greater especially in the region of the pouring slot, and may decrease in the casting direction, in order to be able to follow especially well the shrinkage of the cast billet in response to cooling, and thereby assure good heat removal.

Basically, measures for optimizing the conicity have the predominant aim of improving heat removal in the casting direction, by adapting the inside contour to the shrinkage of the strand shell. The majority of the permanent chill molds used these days is optimized to a certain operating point with regard to conicity, the operating point being a function of several parameters, such as casting speed, steel composition and the cooling conditions. When it comes to deviations from the predetermined operating point, the chosen geometry may lead to interference in the casting process and the billet quality, because on the billet, a so-called strand shell develops, as solidification of the molten metal in the casting bath level sets in. In the case of inappropriate permanent chill mold geometry of the chill tube, the strand shell may lift off and rotate, or, in the opposite case, that is, at too little shrinkage, this may lead to great friction at the chill tube. Bucking or jerking of the billet, billet spalling or even break-out may be the result. The air gap between the chill tube and the strand shell also brings about irregular heat removal, the strand shell melts again with the result of external and internal cracks in the billet. Therefore, there exists a multitude of efforts to adjust the conicity exactly to a certain application case, in order thereby to achieve optimum casting speeds.

In EP 0 958 871 A 1 it is proposed, for this purpose, to vary the conicity in at least a partial length of the casting cone, along a circumferential line, in such a way that each section of the circumferential line forms a smooth curve between the corner areas, with the conicity decreasing in the casting direction. Although this design of the mold cavity represents the theoretically optimum geometry for a certain set of parameters, in practice there will still be parameter fluctuations, conditioned, for example, upon temperature control or upon changed steel compositions which make it impossible durably to maintain the predetermined operating point of the permanent chill mold.

SUMMARY OF THE INVENTION

Accordingly, it is an object of the invention to set forth a permanent chill mold for the continuous casting of metals in which high casting speed at a desired billet quality may be run even when deviations from the operating point come about, and the shrinkage ratios of the metal inside the permanent chill mold change.

This object is attained by a permanent chill mold for the continuous casting of metal, comprising a mold cavity (2), the mold cavity (2) having a pouring slot (3), an exit opening (4) and a casting cone (6), wherein at least one concave bulging (7, 7*a*, 7*b*) is provided that extends in the casting direction (G), which begins at a distance (A) below a predetermined casting bath level position (5) and extends up to the exit opening (4).

BRIEF DESCRIPTION OF THE DRAWINGS

The invention is described in greater detail below, using an exemplary embodiment represented in the schematic drawings. The figures illustrate the following.

DETAILED DESCRIPTION OF THE INVENTION

Figure 1:
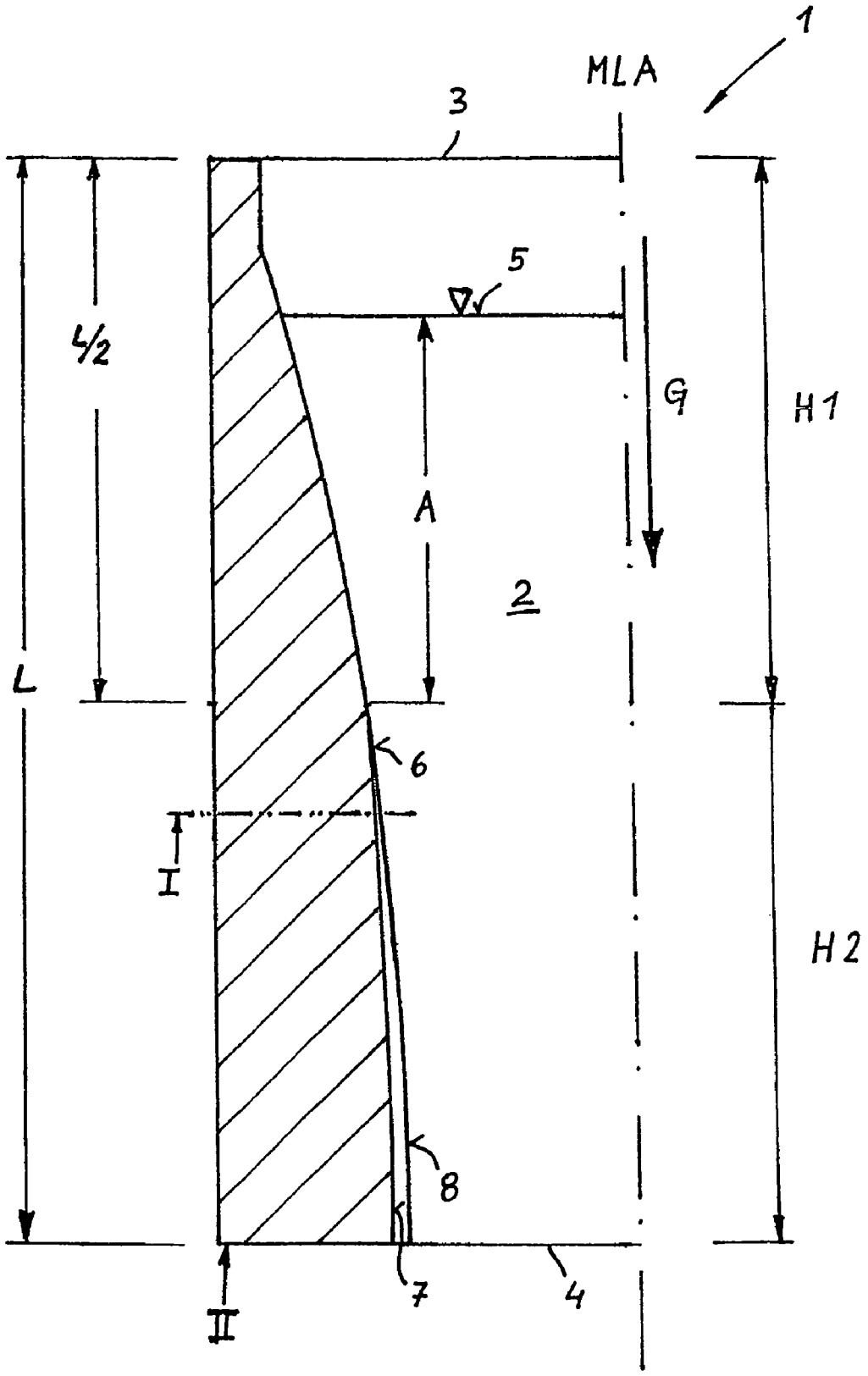
FIG. 1 a sidewall of a permanent chill mold in longitudinal section.

What is essential in the permanent chill mold according to the present invention is that at least one concave bulging or barrelling is provided that extends in the casting direction, which begins at a distance below a predetermined casting bath level position and extends up to the exit opening. Preferably, a plurality of bulgings is provided, so that in the lower height section of the permanent chill mold an undulated profiling, so to speak, comes about over the entire circumference or even only partial circumferential regions, in contrast to the straight side surfaces that occur in the normal case. The at least one concave bulging permits the strand shell of the solidified metal to position itself more or less greatly into the bulging provided for this, in response to deviations from the operating point. In this context, however, the strand shell is securely guided at all times, so that, for example, a twisting or a shaping in a rhomboid fashion of the strand shell is able to be avoided. In the case of casting parameters that lead to increased shrinkage, the proposed permanent chill mold geometry makes possible, for example, that the strand shell is preferably guided at the higher-lying surfaces, that is, at the edges of the concave bulgings. In the opposite case, that is, if the shrinkage of the strand shell is too little, the latter is able to dip more greatly into the concave bulgings. In spite of the dipping, the friction between the strand shell and the mold cavity body is substantially less than in the case of cross sectional contours having essentially straight circumferential contours.

To be sure, in the case of the permanent chill mold according to the present invention, one has to accept that the contact of the casting billet does not occur completely over the full surface, and, because of the slightly worse cooling resulting from this, speeds can be run that are not entirely maximum, but the method safety is decisively improved, without perceptible quality forfeits taking place. In addition, the greatly predominant part of the surface of the mold cavity is in direct contact with the melt and the solidifying strand shell, since the bulgings do not extend over the entire length of the mold cavity, but begin only at a distance below the predetermined casting bath level. This means that the region lying above the bulgings is essentially smooth, and this means especially that it has no such bulgings as are provided only at the lower height of the permanent chill mold, Besides this, there are, of course, casting funnels which, for instance, in the case of convex tubes, begin approximately at the height of the casting bath level and extend to one-half the length of the mold cavity.

The at least one concave bulging begins at an initial region which extends from 30% to 70%, preferably from 40% to 60% of the mold cavity, measured from the pouring slot. In particular, the at least one bulging begins at one-half the length of the mold cavity. Not all bulgings necessarily have to begin exactly at the same height position. It is quite conceivable that the bulgings begin at different height positions. What is essential is that the bulgings begin at a region where a sufficiently thick strand shell has already formed, and which already has a certain mold stability. That is why the distance between the predetermined casting bath level and the at least one concave bulging should be dimensioned sufficiently large. The clearance is preferably greater than 10%, in particular greater than 20% of the length of the mold cavity. Advantageously, at least one concave bulging is present per surface of the mold cavity.

It is regarded as particularly advantageous if the conicity at the deepest part of the at least one concave bulging decreases more rapidly than at the edge of the concave bulging. In particular, the conicity at the deepest part of the concave bulging may decrease down to 0% per meter, whereas the conicity at the edges of the bulgings decreases down to a range of 0.6% per meter to 1.5% per meter. In other words, the depth of the bulgings increases in the casting direction.

In the design of the permanent chill mold according to the present invention, with regard to the conicity, a certain theoretical operating point should be assumed, the curve of the conicity in the region of the bulgings, resulting from this, being defined neither exclusively by the edges nor by the deepest of the bulgings. Rather, it is provided that adjacent bulgings form an undulated profile, the imaginary center line of the undulated profile forming the determining optimum line for the design of the permanent chill mold with respect to the conicity. When the operating point of the permanent chill mold is achieved, this means that a part of the strand shell moves into the bulgings, while another part is supported at the edges and the wave crests of the undulated profile. In the case of deviations in the shrinkage, that is, in the case of deviations from the optimum line, the strand shell is still guided by the concave bulgings within the permanent chill mold. There is only an increase or a decrease in friction, but without danger of bucking of the billet or cracks in the billet.

It is provided that the conicity at the edges of the bulgings, that is, at the wave crests, decreases down to a range of 0.9% per meter to 1.1% per meter. If the conicity is to be reduced, for instance, from 2.5% per meter, at the initial region of the casting cone, to 0.5% per meter, and the conicity at the edges of the bulgings is at 1% and 0% at the deepest part of the bulgings, it follows that the center line of the undulated profile approximates a conicity of the desired 0.5% per meter.

The maximum depth of the concave bulgings, measured from the edges of the bulgings to the deepest part, lies in a range of 0.3 mm to 1 mm, and preferably amounts to approximately 0.5 mm. Because of the faster decrease in conicity at the deepest part of the concave bulging in the casting direction, the depth increases, the maximum depth being attained at the exit opening.

In order to avoid material stresses within the cast billet as well as in order to achieve a uniform wear picture of the mold cavity, it is regarded as advantageous to position the concave bulgings symmetrically in a mold cavity having cross section that is rectangular, polygonal or cylindrical. In the case of a mold cavity that is cylindrical in cross section, the bulgings are preferably positioned diametrically. In the case of cylindrical mold cavities, the number of concave bulging may also be uneven. In this case, an attempt is made to achieve a uniform distribution, that is, a rotationally symmetrical distribution of the bulgings over the circumference, the circular arc between two adjacent recesses extending over 360°/n, n being the number of bulgings. Accordingly, in the case of a mold cavity having a rectangular or polygonal cross section, in a preferred design, concave bulgings are provided in each side of the permanent chill mold.

Discontinuities or buckles in the conicity curve are able to be avoided in that the location-dependent conicity in the casting direction of the mold cavity element is a curve describable by a continuous function. This means especially that the concave bulgings do not begin discontinuously but have a transition that is gentle and as rounded as possible, which can be described by a continuous function. Alternatively, the contour may also be described by a suitable and sufficiently large number of straight sections. In the circumferential direction, that is, transversely to the casting direction, the contour of the concave bulgings should also be a curve that is ideally described by a continuous function. Alternatively, the contour may be composed of straight lines and/or circular sections. Because of transitions that are rounded and as soft as possible, the friction between the strand shell and the mold cavity is able to be reduced.

The permanent chill mold according to the present invention is able to be reshaped in a non-cutting manner to form the contour. Naturally, in order to form the at least one concave bulging, a cutting processing is also possible. It is regarded as particularly advantageous if the contour of the at least one concave bulging is produced at least partially by a depositing method. Depositing methods within the meaning of the present invention are preferably electrolytic depositing methods, in which metals such as chromium, copper and nickel or their alloys are deposited on the inner surface of the mold cavity. The desired contour of the concave bulgings may also be attained by suitable electrode support or the electrode geometry, so that coatings of different thicknesses may result. Basically, it may be sufficient to produce the desired geometry of the concave bulgings exclusively by the depositing method. If, however, concave bulgings having great depths are desired, it may be expedient to combine a non-cutting or a cutting reshaping with a depositing method, so that the contour of the at least one concave bulging is produced at least partially by a depositing method. Basically, coating the mold cavity is recommended, in order to increase the resistance to wear and thereby the service life of the permanent chill mold. For this reason, too, it is expedient to provide thicker coatings at the edges of the concave bulgings than at the deepest places of the concave bulgings, since, at the deepest places, lesser wear is to be expected than at the exposed edges of the bulgings.

The contour of the at least one concave bulging may be produced at least partially, that is, possibly in combination with another processing method, by a depositing method, for instance, by an etching method, by laser removal or by electrochemical methods.

In longitudinal section, FIG. 1 shows the wall of a permanent chill mold 1 for the continuous casting of metal. The representation is purely schematic, is in no way according to scale and is used only to illustrate the idea of the present invention.

Permanent chill mold 1 is developed symmetrically with respect to its longitudinal center axis MLA. Permanent chill mold 1 is made up of copper or a copper alloy, and is cooled from the outside, in a manner not shown in greater detail, so that a metal melt introduced into permanent chill mold 1 solidifies from outside to inside and develops a strand shell. The permanent chill mold 1 has for this purpose an especially contoured mold cavity 2, whose conicity K is adjusted to the shrinkage behavior of the metal melt. Mold cavity 2 has a pouring slot 3 and an exit opening 4. The casting direction is characterized by arrow G. During the continuous casting procedure, the metal melt is held within a predetermined casting bath level position 5. Conditioned upon the method, casting bath level position 5 fluctuates within certain limits about predetermined casting bath level position 5, that is, the setpoint position. Permanent chill mold 1 is cooled from the outside, and therefore a solidifying of the metal melt sets in below casting bath level position 5, the strand shell forms, and then shrinks. The casting cone designated by 6 evens out the volume absorption of the melt and the strand shell to a certain quantity. Conicity K of casting cone 6 changes in the longitudinal direction of permanent chill mold 1. Conicity K begins at ca. 2.5% per meter and decreases in casting direction G to approximately 0.5% per meter.

Permanent chill mold 1 according to the present invention subdivides in this exemplary embodiment into two different height ranges. Upper height range H1 extends from pouring slot 3 to one-half the length L of permanent chill mold 1. Lower height range H2 begins in the middle of permanent chill mold 1 and extends to exit opening 4. What is important is that lower height range H2 begins at a distance A below the predetermined casting bath level position 5, since lower height range 2 has quite a special contouring for the adjustment of shrinkages of different extents. This contouring only begins in lower height range H2, where a sufficiently firm strand shell has formed. In permanent chill mold 1 according to the present invention, concave bulgings 7 are provided that extend in casting direction G, and extend up to exit opening 4. Depth T of bulgings 7 increases in casting direction G. Bulgings 7 do not begin discontinuously, but have a depth T which gradually increases in casting direction G. A smooth transition to upper height range H1 comes about in that, in casting direction G, bulgings 7 have a more greatly decreasing conicity K2 in deepest part 9 of bulgings 7 than at their edges 8. Details will be explained below, with the aid of FIG. 2.

Figure 2:
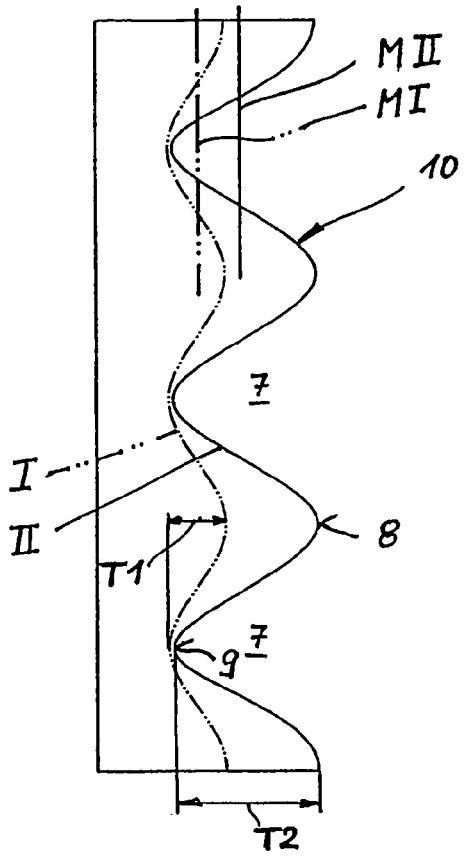
FIG. 2 cutouts from two different cross sectional planes I and II of FIG. 1 in enlarged illustration.

The double dotted line in FIG. 2 shows the surface contour of casting cone 6 in the area of cross sectional plane I, as shown in FIG. 1. The second line shows the curve of the surface contour at exit opening 4. We point out that the courses of the curves are quite overdrawn for the sake of illustration, and therefore also do not agree with the dimensioning in FIG. 1. It may be recognized that the amplitude is greater in cross sectional plane II than in cross sectional plane I. That means that depth T of the bulgings increases in casting direction G. In cross sectional plane I, depth T1 is only half as great as in cross sectional plane II, where depth T2 is to be measured between deepest part 9 and edge 8 facing mold cavity 2. At the same time, one may recognize that conicity K at the lowest point 9 of bulgings 7 decreases more greatly than between edges 8, since deepest parts 9 in this illustration are at a shorter distance from one another than edges 8

Figure 3:
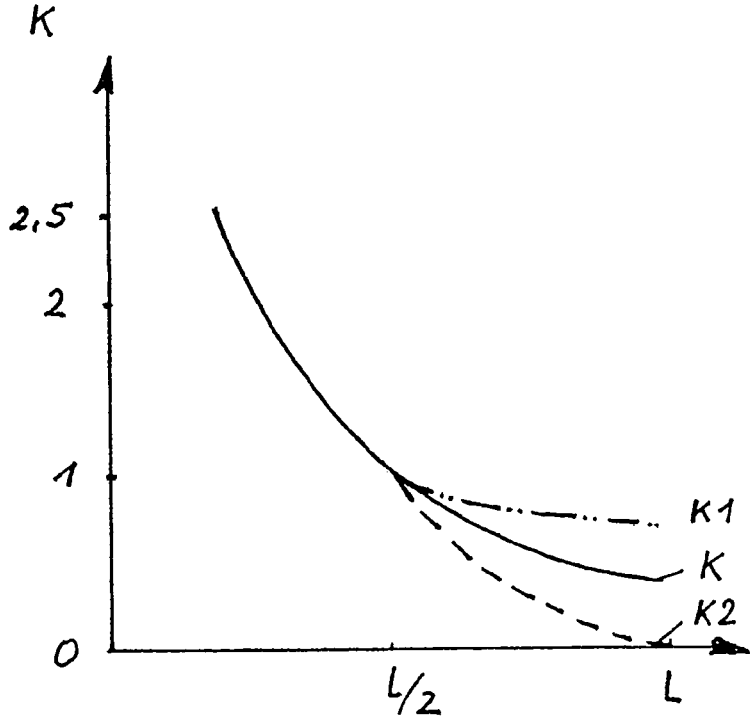
FIG. 3 the conicity of the sidewall of the permanent chill mold plate of FIG. 1, plotted against its length.

Permanent chill mold 1 is designed in such a way that center position MI and MII of drawn-in undulated profile 10 corresponds to the optimum line that is determining with regard to the conicity. In this connection, the respective center line MI, MII is composed of the permanent chill mold longitudinal direction-dependent position of deepest parts 9 and edges 8 of bulgings 7. FIG. 3 clarifies this factual situation. One may recognize that conicity K is relatively high at 2.5% per meter in the vicinity of pouring slot 3, and that it decreases continuously in casting direction G. Bulgings 7 begin approximately in the middle of the permanent chill mold at L/2, the overall conicity being composed of conicity K1 and conicity K2. Conicity K1 is measured in each case at edges 8 of bulgings 7, and is drawn in using a dash-dotted line. Conicity K2 is measured at the respectively deepest points of bulgings 7, and is drawn in using a dashed line. Conicity K1 decreases only slowly at edges 8, and moves about 1% per meter, as far as order of magnitude is concerned. By contrast, conicity K2 decreases more rapidly in the deepest part 9 of bulgings 7, and even amounts to 0% per meter at exit opening 4 of permanent chill mold 1. The superposition of conicities K1, K2 leads to overall conicity K, at an order of magnitude of approximately 0.5% per meter.

Because of additional bulgings 7 in lower height range H2 of permanent chill mold 1 it is possible to compensate for parameter fluctuations conditioned upon different casting temperatures, upon alloy compositions or upon different positions of the casting bath level, within certain limits. This avoids clamping of the billet, which may lead to bucking of the billet, spalling of the billet or even break-out of the billet.

Figure 4:
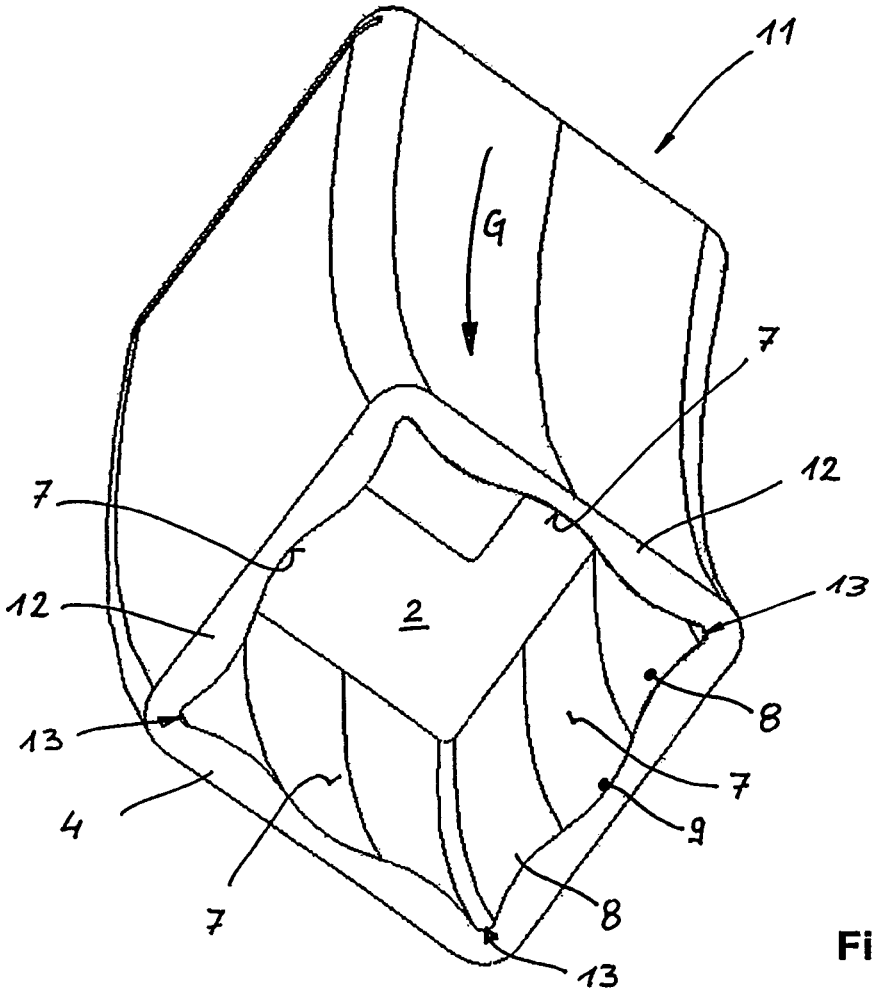
FIG. 4 a perspective view of a chill tube in a direction of view towards the permanent chill mold exit.

FIG. 4 shows a perspective view of a permanent chill mold 11, in the description of the geometry the reference symbols already introduced for FIGS. 1 and 2 being used below. Mold cavity 2 of permanent chill mold 11 is essentially subdivided into two sections, in casting direction G. The upper height range facing pouring slot 3 is executed smoothly, at half the length of permanent chill mold 11 a lower height range adjoining the upper one, and it has a plurality of concave bulgings. In each case one concave bulging 7 is provided in the middle of each permanent chill mold side 12. In addition, corner regions 13 between two abutting permanent chill mold sides 12 are provided with bulgings 7. All bulgings 7 are executed in rounded form, as seen transversely to the casting direction, a side-by-side arrangement of curve sections being involved. In turn, it is important in permanent chill mold 11 that concave bulgings 7 begin at a certain distance below the predetermined casting bath level and extend up to exit opening 4. The geometry of bulgings 7 is selected so that an optimum line comes about with regard to the conicity, which is defined neither by deepest part 9 nor edge 8 of bulgings 7, but by the superpositions of all the conicities.

Figure 5:
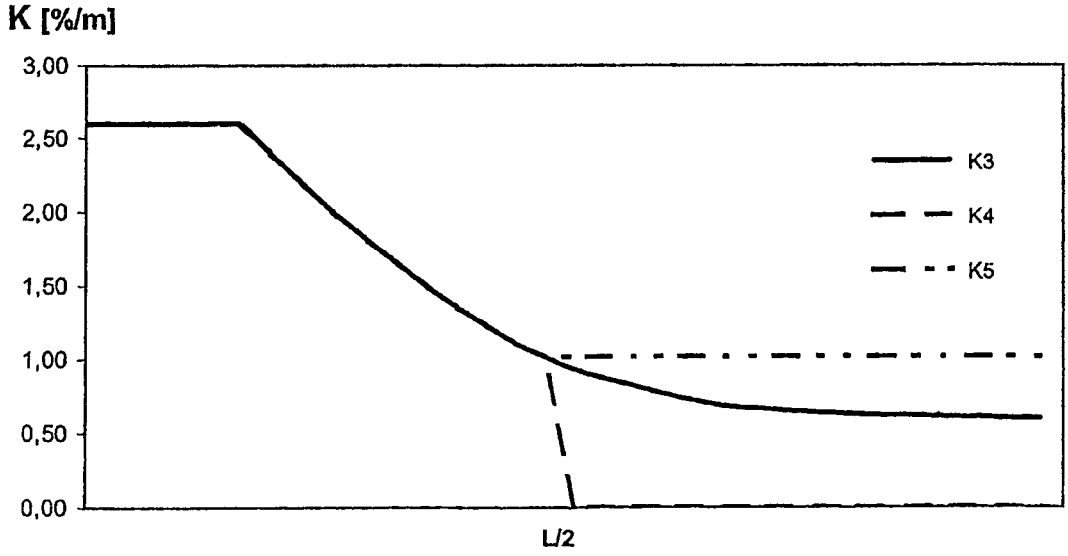
FIG. 5 the conicity of the sidewall of the permanent chill mold of FIG. 4, plotted against its length.

Analogously to FIG. 3, FIG. 5 shows the conicity curve of the exemplary embodiment of FIG. 4. It may be recognized that conicity K3 is first of all constant in the region of the pouring slot, and that it subsequently decreases continuously in the casting direction. Conicity K3 first decreases rather rapidly, the graph of K3 flattening out in the direction of exit opening 4. In the lower height region, that is, approximately beginning at L/2, concave bulgings 7 begin in the individual permanent chill mold sides 12. In this connection, K4 stands for the conicity that is measured in the deepest part 9 of bulgings 7. K5 stands for the conicity that is measured at edges 8 of bulgings 7. Conicity K4 in the deepest part of bulgings 7 drops off to 0 at L/2, while the conicity at edges 8 of bulgings 7 is approximately 1. Average conicity K3 lies between conicities K4 and K5.

Figure 6:
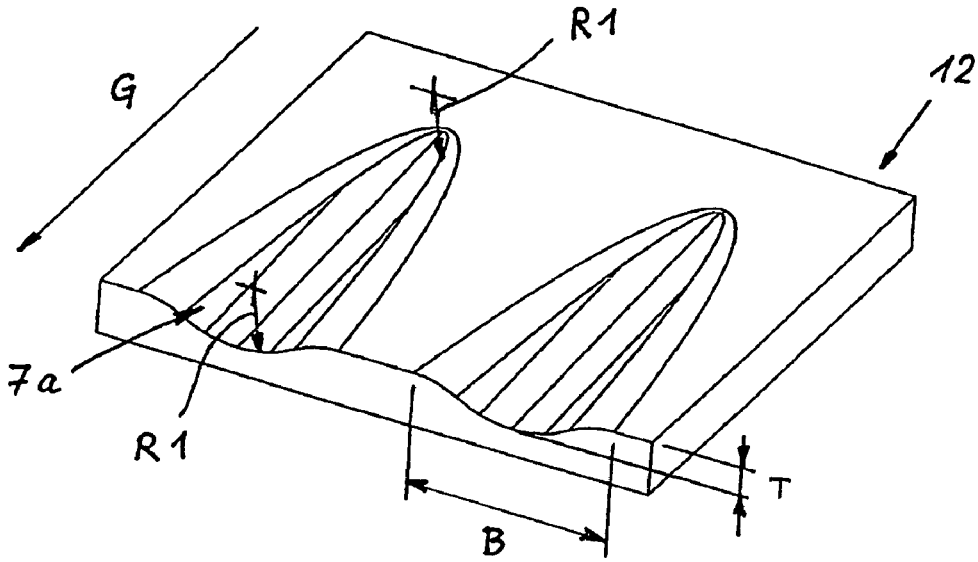
FIG. 6 a partial region of a permanent chill mold plate having two concave bulgings in a first specific embodiment and FIG. 7 a partial region of a permanent chill mold plate having two concave bulgings in a second specific embodiment.
Figure 7:
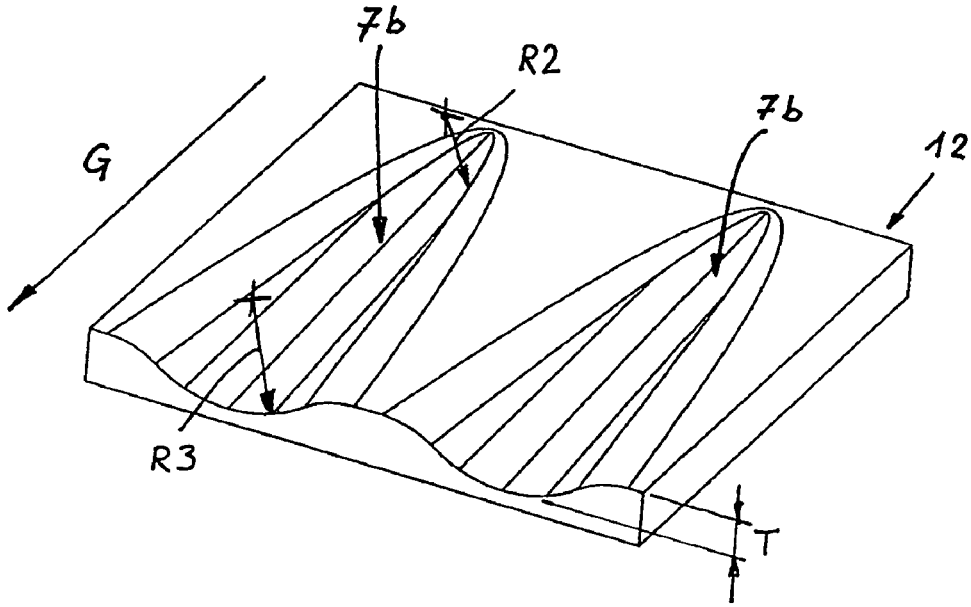

FIGS. 6 and 7 show cutouts of permanent chill mold sides 12, into which there have been introduced respectively differently configured bulgings 7*a*, 7*b*. The length of bulgings 7*a*, 7*b* with reference to permanent chill mold side 12 that is shown is unimportant in this connection, since exclusively the geometry of bulgings 7*a*, 7*b* is to be explained.

Depth T and width B of bulgings 7*a*, 7*b* increase continuously in the casting direction. It is, however, recognizable that radius R1 of bulging 7*a* is constant over the entire length. This geometry comes about from the penetration of a circular cylinder that is slightly inclined with respect to the surface of chill mold side 12 by chill mold side 12. In order to maintain a rounded geometry transversely to casting direction G, the transitions to edges 8 of bulgings 7*a* were rounded.

The specific embodiment of FIG. 7 differs from the previous one in that the radius of the bulgings increases in the casting direction. One is able to recognize that radius R2 at the narrow end of bulging 7*b* is smaller than radius R3 at the wide end of bulging 7*b*. This geometry comes about from the penetration of chill mold plate 12 by a circular cone, the vertical axis of the circular cone running parallel to the surface of the mold cavity. This circular cone may, of course, be additionally inclined, in order to vary the depth curve and the width curve of bulging 7*b*. In this exemplary embodiment, too, edges 8 of bulging 7*b* are executed in rounded form, so that a certain undulated profile comes about on the exit side.

LIST OF REFERENCE NUMERALS

1—permanent chill mold
2—mold cavity
3—pouring slot
4—exit opening
5—casting bath level position
6—casting cone
7—bulging
7*a*—bulging
7*b*—bulging
8—edge of 7
9—deepest part of 7
10—undulated profile
11—permanent chill mold
12—mold side
13—corner region
MLA—center longitudinal axis of 1
G:—casting direction
HI—upper height range
H2—lower height range
L—length of the permanent chill mold
A—distance between 5 and H2
B—width of 7*a*
T—depth
T1—depth
T2—depth
R1—radius of 7
R2—radius of 7*a*
R2—radius of 7*b*
MI—average position of 10 at I
MII—average position of 10 at II
K—conicity
K1—conicity
K2—conicity
K3—conicity
K4—conicity

What is claimed is:

1. A permanent chill mold for the continuous casting of metal, comprising a mold cavity, the mold cavity having a pouring slot, an exit opening and a casting cone, wherein at least one concave bulging is provided in a longitudinal profile of the casting cone that extends along a casting direction, which concave bulging begins at a distance below the pouring slot and extends up to the exit opening;

wherein a beginning of the at least one concave bulging is in an initial region, the initial region extending from 30% to 70% of a mold cavity length measured from the pouring slot.

2. The mold as recited in claim 1, wherein the at least one concave bulging begins at half the length of the mold cavity.

3. The mold as recited in claim 1, wherein the mold is on figured to be filled to a predetermined casting bath level position and wherein a distance between the predetermined casting bath level position and the at least one concave bulging is greater than 10% of a length of the mold cavity.

4. The mold as recited in claim 1, wherein the mold is configured to be filled to a predetermined casting bath level position and wherein a distance between the predetermined casting bath level position and the at least one concave bulging is greater than 20% of the length of the mold cavity.

5. The mold as recited in claim 1, wherein the conicity decreases more rapidly in a deepest part of the at least one concave bulging than at an edge of the at least one concave bulging.

6. The mold as recited in claim 1, wherein the conicity at a deepest part of the at least one concave bulging decreases down to at most 0% per meter.

7. The mold as recited in claim 1, wherein the conicity at edges of the bulgings decreases to a range of 0.6% per meter to 1.5% per meter.

8. The mold as recited in claim 1, wherein adjacent bulgings form an undulating transverse profile.

9. The mold as recited in claim 1, wherein the concave bulgings are symmetrically positioned and the mold cavity has a rectangular, polygonal or cylindrical cross section.

10. The mold as recited in claim 9, wherein the concave bulgings are diametrically positioned and the mold cavity has a cylindrical cross section.

11. The mold as recited in claim 1, wherein at least one concave bulging is provided in each mold side of the mold cavity and the mold cavity is rectangular or polygonal in cross section.

12. The mold as recited in claim 1, wherein the conicity of the mold cavity, that is a function of location in the casting direction (G), is a curve that is describable by a continuous function.

13. The mold as recited in claim 1, wherein the conicity of the mold cavity, that is a function of location in the casting direction (G), is defined by a side-by-side arrangement of at least one of curve sections and straight line sections.

14. The mold as recited in claim 1, wherein a contour of the at least one concave bulging transversely to the casting direction is a curve that is describable by a continuous function.

15. The mold as recited in claim 1, wherein a contour of the at least one concave bulging transversely to the casting direction is defined by a side-by-side arrangement of at least one of curve sections and straight line sections.

16. The mold as recited in claim 1, wherein a contour of the at least one concave bulging is produced at least partially by a depositing method.

17. The mold as recited in claim 1, wherein a contour of the at least one concave bulging is produced at least partially by a material removal method.

* * * * *